US006306517B1

(12) United States Patent
Gray et al.

(10) Patent No.: US 6,306,517 B1
(45) Date of Patent: Oct. 23, 2001

(54) THERMAL BARRIER COATINGS HAVING AN IMPROVED COLUMNAR MICROSTRUCTURE

(75) Inventors: Dennis Michael Gray, Delanson; Yuk-Chiu Lau, Ballston Lake; Curtis Alan Johnson, Schenectady; Marcus Preston Borom, Niskayuna; Warren Arthur Nelson, Clifton Park, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/632,354

(22) Filed: Aug. 3, 2000

Related U.S. Application Data

(60) Continuation of application No. 08/957,213, filed on Oct. 24, 1997, now Pat. No. 6,180,184, which is a division of application No. 08/681,558, filed on Jul. 29, 1996, now Pat. No. 5,830,586.

(51) Int. Cl.[7] ..... B32B 9/00

(52) U.S. Cl. ..... 428/469; 428/472; 416/241 R; 416/241 B

(58) Field of Search ..... 428/469, 472; 416/241 R, 241 B

(56) References Cited

U.S. PATENT DOCUMENTS

| | | | | |
|---|---|---|---|---|
| 4,321,311 | | 3/1982 | Strangman . | |
| 4,457,948 | | 7/1984 | Ruckle . | |
| 4,676,994 | | 6/1987 | Demaray . | |
| 4,880,614 | | 11/1989 | Strangman . | |
| 5,073,433 | | 12/1991 | Taylor . | |
| 5,238,752 | | 8/1993 | Duderstadt . | |
| 5,652,044 | * | 7/1997 | Rickerby | 428/216 |
| 5,830,586 | | 11/1998 | Gray . | |

* cited by examiner

*Primary Examiner*—Deborah Jones
*Assistant Examiner*—Bryant Young
(74) *Attorney, Agent, or Firm*—Noreen C. Johnson; Douglas E. Stoner

(57) ABSTRACT

An article having a spallation resistant TBC comprises a metal substrate, such as a high temperature superalloy, and a TBC, such as a coating of yttria stabilized zirconia. The TBC comprises a plurality of plasma-sprayed layers. The TBC has a coherent, continuous columnar grain microstructure, wherein at least one layer has a plurality of continuous columnar grains which have been extended by directional solidification into an adjacent layer.

4 Claims, 8 Drawing Sheets

"PRIOR ART"

"PRIOR ART"

"PRIOR ART"

"PRIOR ART"

70

THERMAL BARRIER COATINGS HAVING AN IMPROVED COLUMNAR MICROSTRUCTURE

This application is a continuation of application Ser. No. 08/957,213 now U.S. Pat. No. 6,180,184, filed Oct. 24, 1997 which is a division of of Ser. No. 08/681,558, filed Jul. 29, 1996, U.S. Pat. No. 5,830,586, which is hereby incorporated by reference in its entirety.

BACKGROUND OF THE INVENTION

The present invention relates to air plasma spray (APS) thermal barrier coatings (TBCs) such as are commonly applied to articles for use in high temperature environments. More specifically, the present invention comprises APS TBCs having a coherent, continuous columnar grain microstructure and a preferred vertical crack pattern which enhance the physical and mechanical properties of these coatings in ways which are intended to improve their resistance to spalling in cyclic high temperature environments.

APS TBCs are well known, having been used for several decades. They are typically formed from ceramic materials capable of withstanding high temperatures and are applied to metal articles to inhibit the flow of heat into these articles. It has long been recognized that if the surface of a metal article which is exposed to a high temperature environment is coated with an appropriate refractory ceramic material, then the rate at which heat passes into and through the metal article is reduced, thereby extending its applicable service temperature range, service longevity, or both.

Prior art APS TBCs are typically formed from powdered metal oxides such as well known compositions of yttria stabilized zirconia (YSZ) These TBCs are formed by heating a gas-propelled spray of the powdered oxide material using a plasma-spray torch, such as a DC plasma-spray torch, to a temperature at which the oxide powder particles become momentarily molten. The spray of the molten oxide particles is then directed onto a receiving metal surface or substrate, such as the surface of an article formed from a high temperature Ti-based, Ni-based, or Co-based superalloy, thereby forming a single layer of the TBC. In order to make TBCs having the necessary thicknesses, the process is repeated so as to deposit a plurality of individual layers on the surface of interest. Typical overall thicknesses of finished TBCs are in the range of approximately 0.010–0.055 inches.

The microstructure of a typical prior art TBC formed by APS deposition is described now by reference to FIGS. 1*a* and 1*b*. FIGS. 1*a* and 1*b* are scanning electron microscope (SEM) photomicrographs of fracture surfaces through the thickness of a prior art TBC taken at magnifications of 50× and 3000×, respectively. The TBC has been removed by acid dissolution of the metal article on which it was deposited, and fractured to expose the characteristics of the resulting microstructure.

In order to make the TBC of FIGS. 1*a* and 1*b*, the TBC was deposited using an apparatus comprising an air plasma spray torch positioned adjacent to a rotatable cylindrical metal drum for holding the articles to be coated. The plasma spray torch was positioned at a distance from the drum and perpendicular to its axis such that it could be moved along a line parallel to the axis. A TBC was deposited by rotating the drum containing a metal article, comprising an approximately 0.125 inch thick coupon of a Ni-based alloy, while the plasma spray torch was moved in a path parallel to the drum axis, so as to make one pass across the exposed top surface of the metal coupon. Each rotation of the drum carried the plasma-spray torch onto, across and off the top surface of the coupon and resulted in the deposition of what is termed herein as a "single sub-layer" or simply a "sub-layer" of the TBC. The "spray pattern" or "footprint" of the torch deposit as termed herein, is a cross-section of the spray pattern of molten particles having a finite size, e.g. one-half inch in diameter. The footprint may be circular or other shapes depending on the shape of the plasma-spray stream, the angle of the surface of the article being deposited to the stream, and other factors. The size of the footprint is largely a function of the distance of the article from the plasma-spray gun and the shape of the plasma-spray stream. Depending on the combination of drum rotation rate and torch traverse rate, multiple sub-layers may be deposited at a given spot as the torch footprint passes over in a single pass. Therefore, a "primary layer", as termed herein, comprises the thickness of TBC of coating deposited in a single pass of the torch and may, and most often does, consist of a plurality of sub-layers. A "torch holiday", as termed herein, occurs when the plasma-spray torch from which a TBC is being deposited moves away from the area on the article on which the TBC is being deposited so that cooling of the surface occurs, or when the article is moved out from under the plasma-spray torch, or when the motion of both the article and the torch causes the area being deposited to be moved away from the stream of plasma-sprayed particles.

Referring to FIGS. 1*a* and 1*b*, the TBC was deposited in multiple passes, wherein the plasma spray torch was translated back and forth across the top surface of the coupon. During the passes, the drum upon which the coupon was secured was also rotated at a speed such that each area of the coupon being deposited with the TBC passed under the plasma-spray torch footprint a plurality of times during each pass, for example 4 to 5 times. This method of deposition produced layers in two respects, a primary layer resulted from each repeated translation of the torch across the surface of the substrate, secondary or sub-layers resulted from multiple rotations of the drum. In FIGS. 1*a* and 1*b*, the TBC includes about 150 primary layers resulting from the combination of the rotation of the drum and the translation of the torch.

The TBC shown in FIGS. 1*a* and 1*b* was made from −120 mesh YSZ powder having a composition of 8% yttria by weight with a balance of zirconia, and was deposited using a perimeter feed DC plasma spray torch, Model 7MB made by Metco Inc. The torch current was approximately 500 A, and the distance of the plasma spray flame to the surface of the article was approximately 3–5 inches. The deposition temperature measured at the back surface of the coupon was less than 260° C. The resulting TBC was approximately 0.050 in. thick. Applicants believe that the TBC shown in FIGS. 1*a* and 1*b* is representative of prior art TBC generally.

FIG. 1*a* reveals a rough and irregular fracture surface, the reasons for which are more readily apparent from examination of FIG. 1*b*. The fracture surface of FIG. 1*b* is made up of what appears to be a stack of many discrete particles which do not share a common fracture plane, but which are rather fractured jaggedly along a path of what appears to have been weaker points within and between the individual particles. This jagged fracture path explains the rough appearance at the lower magnification of FIG. 1*a*. The explanation for the appearance of this fracture surface is given below.

As noted above, the TBC comprises a plurality of layers as a result of the combination of rotation of the drum and translation of the torch and area of the torch footprint. These layers are formed from the stream of individual molten particles of YSZ, which impact either the surface of the coupon, or particles from a previously deposited TBC layer. Upon impact, molten particles are joined to the metal article in part by a physical mechanical interlocking of the molten particles within the features provided by the surface roughness of the article, or to previously deposited particles by a process known as micro-welding, which is described further below. Applicants have observed in FIG. 1*b,* and in the examination of similar prior art TBCs, that the majority of these particles appear to be weakly bonded to particles in prior and subsequent sub-layers, and that micro-welding between sub-layers appears to be very limited; as evidenced by the distinct surfaces which still appear as demarcations between these sub-layers, such as are shown in FIG. 1*b.*

Referring to FIG. 1*b,* the particles appear as irregularly shaped platelets, and exhibit internally a fine-grained, columnar structure which is formed in a direction generally perpendicular to the contact surface of the underlying platelet or platelets (arrow 10 points in the direction of the outer surface of the TBC). Limited micro-welding between particles is indicated by the lack of a continuous, columnar grain structure between adjacent sub-layers. The lack of micro-welding results in an irregular, randomly oriented microstructure within the YSZ having the general appearance of compressed popcorn or polystyrene beads. Applicants believe that such a microstructure results because the combination of the heat contained within the molten powder particles and the heat contained on the deposition surface during the deposition is not sufficient to cause localized re-melting under the area where one particle impacts a previously deposited particle, resulting in limited or non-existent micro-welding between the deposited particles, and hence between sub-layers.

Limited micro-welding, as seen in FIGS. 1*a* and 1*b,* also results in a microstructure that exhibits a significant amount of both horizontal and vertical cracks, i.e. cracks oriented parallel to and normal to the substrate interface, respectively, surrounding such particles. For example, referring again to FIG. 1*b,* it will be further observed that some of the impacted particles have what appear to be gaps or separations between them.

Applicants have observed that even when the micro-welding between individual particles has been improved such that columnar grain growth occurs continuously between individual particles, such continuous columnar growth does not extend coherently (as described further below) across the boundaries between the layers that comprise prior art TBCs. Thus, while some columnar ordering of adjacent particle sub-layers comprising the microstructure of prior art TBCs may occur, this ordering is limited, and the lack of coherency between layers often results in horizontal cracking in the regions between layers for the same reasons as discussed above. In fact, a low deposition surface temperature (due to the torch holiday which defines a layer) during the deposition of either sub-layers or layers decreases the likelihood that micro-welding will occur and increases the potential for creation of both horizontal and vertical cracks during the deposition. Therefore, cracking which occurs between layers may be even more severe, and result in horizontal macrocracks (cracks which extend over distances that are substantially larger than the diameter of an individual particle).

One well recognized problem in the use of prior art TBC coatings, particularly on articles routinely cycled from ambient conditions up to extremely high temperatures such as those used in gas turbines, is that the exposure of TBCs to the very intense heat and rapid temperature changes associated with high velocity combustion gases can cause their failure by spallation, or spalling of the TBC from the surfaces of the metal articles which they are designed to protect, possibly due to thermal fatigue. Susceptibility to spallation in cyclic thermal environments is primarily due to the existence of horizontal cracking or in-plane (of the TBC) cracking. Horizontal cracks are known particularly to increase the susceptibility of a TBC to spallation because in-plane stresses, such as in-plane stresses created during the TBC deposition process or in service, can cause such horizontal cracks to propagate and grow.

It is known that the spallation resistance of TBCs in such environments can be improved by modifying certain characteristics of the coatings. For example, in the article entitled: "Experimental and Theoretical Aspects of Thick Thermal Barrier Coatings for Turbine Applications"; V. Wilms, G. Johner, K. K. Schweitzer and P. Adams; THERMAL SPRAY: Advances in Coatings Technology; Proceedings of the National Thermal Spray Conference; Orlando, Fla.; September 1987; pp. 155–166 it is disclosed that the performance of yttria stabilized zirconia (YSZ) TBCs is enhanced in cyclic thermal environments by developing a predominance of cracks normal to the TBC/metal article interface (i.e. vertical cracks) and a minimum of cracks parallel to such interface (i.e. horizontal cracks). Also, U.S. Pat. No. 5,073,433 issued to Taylor teaches that the existence of homogeneously dispersed vertical macrocracking with a controlled amount of horizontal cracking within a TBC reduces the tendency for spalling within the coating, and thus increases the thermal fatigue resistance. However, this patent does not teach any associated microstructural improvements in such TBCs, such as improved micro-welding of adjacent particle sub-layers as described hereinbelow. In fact, U.S. Pat. No. 5,073,433 teaches the necessity of controlling such horizontal cracking.

Applicants have observed that it is possible to develop a preferred vertical macrocrack pattern, as described in U.S. Pat. No. 5,073,433, without otherwise substantially altering the prior art microstructure as described above. A TBC containing vertical macrocracks, horizontal cracks and horizontal microcracks is shown in FIGS. 2*a* and 2*b.* FIG. 2*a* is an optical photomicrograph at 50× magnification of a polished cross-section of a prior art TBC (arrow 20 points in the direction of the outer surface of the TBC) which reveals the presence of preferred vertical macrocracks as described in U.S. Pat. No. 5,073,433. However, FIG. 2*b* which is an electron photomicrograph of a fracture surface of the same coating taken at 2000×, reveals a prior art microstructure similar to that described for FIGS. 1*a* and 1*b,* although the individual particles are not as evident in FIG. 2*b.* However, no long range ordering of the columnar grains is apparent, particularly ordering that would extend beyond the thickness of a single layer which is about 0.0004–0.0005 inches. The approximate thickness of a single deposition layer for this TBC is illustrated by vertical bar 30 for comparison. FIGS. 2*a* and 2*b* also reveal the presence of a substantial amount of horizontal macrocracks and microcracks. The TBC shown in FIGS. 2*a* and 2*b* was also deposited using the apparatus and method described above for the TBC shown in FIGS. 1*a* and 1*b,* under similar conditions. Therefore, it may be seen that it is possible to develop preferred vertical or segmentation cracking in a TBC having substantial undesirable horizontal cracking, due to the existence of a prior art microstructure which does not exhibit sufficient micro-welding, either within or between layers and/or sub-layers, to establish a coherent, continuous columnar grain structure.

Therefore, Applicants have observed that the tendency for spallation in cyclic, high temperature environments which is known to exist in prior art TBCs is related directly to weak or non-existent micro-welding between adjacent particle sub-layers due to a lack of continuous columnar grain growth, particularly between TBC layers, as explained above. Therefore, it is desirable to improve the microstructure of TBCs by improving micro-welding and reducing the amount of horizontal cracking. Applicants herein identify such improved TBCs and their microstructural characteristics.

SUMMARY OF THE INVENTION

Applicants have discovered that the amount of horizontal cracking within ceramic TBCs, particularly YSZ TBCs deposited by APS techniques, is very dependent on the microstructure of the coating.

Applicants have discovered a significant feature of TBCs in that a coherent, continuous columnar microstructure can be developed both within and between the plurality of individual layers which comprise a TBC so as to significantly reduce the amount of deleterious horizontal or in-plane cracking, as evidenced by the improvement of certain mechanical properties of these TBCs such as an increase in the tensile strength of the coating normal to the substrate and a reduction in the effective in-plane elastic modulus.

In a preferred embodiment, a TBC of the present invention comprises a coherent, continuous columnar grain structure of the type described above, wherein at least some columnar grains extend from at or near the interface of a metal article or bond coat on which the TBC is deposited outwardly through the plurality of individual layers to the outer surface of the TBC.

In general, as the degree of columnarity increases, wherein the degree of columnarity is directly related to the quantity and distribution of columnar grains extending both within and between individual coating layers, the amount and/or degree of horizontal cracking within a TBC is reduced and the improvements in certain of the mechanical properties of the coatings noted above are observed. Another feature of the present invention relates to the fact that Applicants have also determined that the temperature of the deposition surface during the deposition process directly affects the degree of columnarity of the grains (i.e. above a threshold temperature, increasing the temperature increases the degree of columnarity). Therefore, the degree of columnarity of the coherent, continuous columnar microstructure may be controlled.

TBCs of the present invention have a significant advantage in the form of improved spallation resistance over prior art TBCs. TBCs of the present invention also contain vertical macrocracks which are also known to improve the spallation resistance of such coatings.

Therefore, it is one object of the present invention to develop an article having a TBC, comprising: a substrate having at least one surface which is adapted to bond a TBC; and a ceramic TBC bonded to the surface of said substrate and comprising a plurality of ceramic layers, each of the ceramic layers of said ceramic TBC having a thickness and a microstructure comprising a plurality of continuous columnar grains which extend completely through its thickness, said TBC also having at least one, but preferably a plurality of ceramic layers in which the plurality of continuous columnar grains from one layer extend into and are coherent within an adjacent layer.

A further object of the present invention is to develop vertical macrocracks within the TBC.

These and other objects, features and advantages of the present invention may be understood by reference to the drawings and detailed description of the invention provided below.

DETAILED DESCRIPTION OF THE INVENTION

Applicants have discovered that it is possible to avoid the formation of TBCs having the prior art microstructures illustrated by FIGS. 1*a* and 1*b* and FIGS. 2*a*–2*b* which generally exhibit a lack of micro-welding and significant horizontal cracking; and form instead a well micro-welded coherent, columnar microstructure both within and between layers, reduced horizontal cracking, and preferred vertical macro-cracking.

Figure 1A:
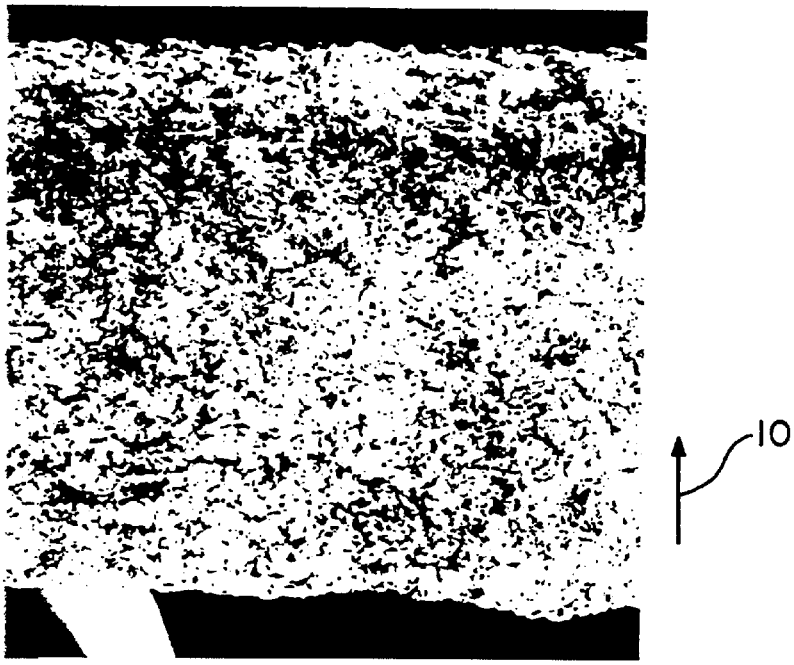
FIG. 1*a* is a SEM photomicrograph of a fracture surface at 50× magnification showing a sectional view through the thickness of a prior art multilayer thermal barrier coating.
Figure 1B:
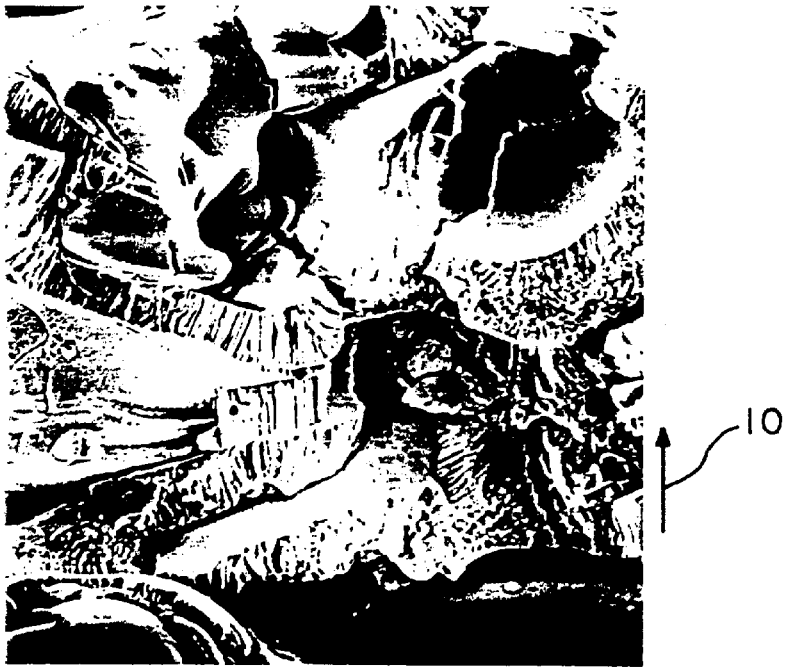
FIG. 1*b* is a 3000× SEM photomicrograph of the fracture surface of FIG. 1*a* in which the random orientation of the grains within the TBC is further illustrated.
Figure 2A:
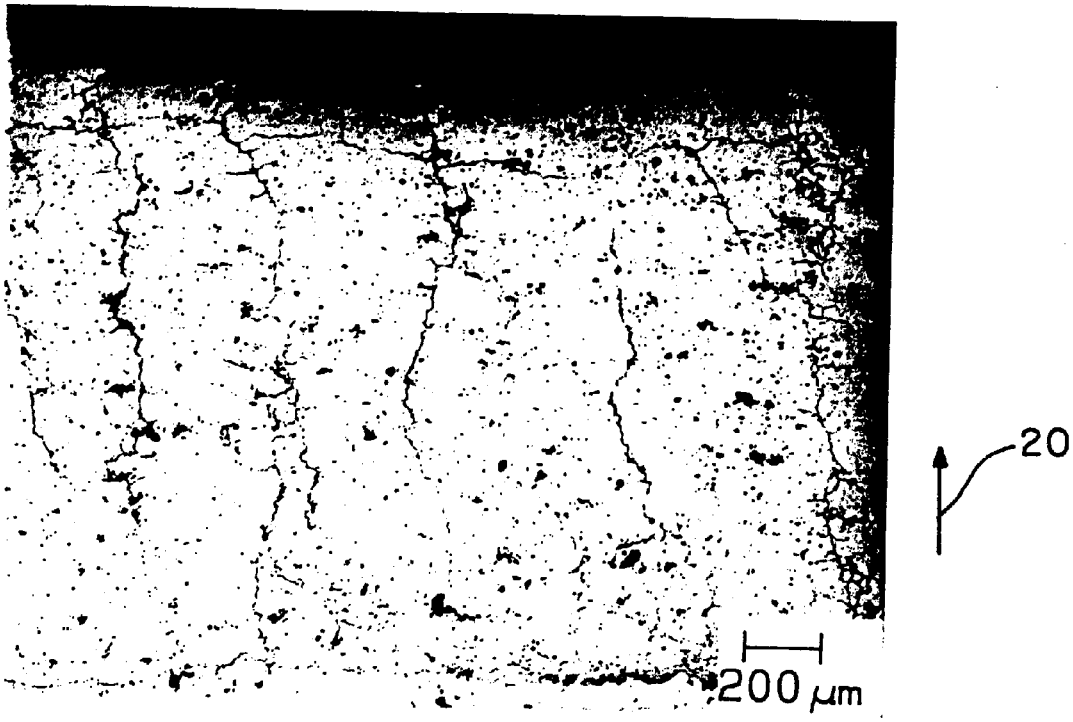
FIG. 2*a* is an optical photomicrograph taken at 150× magnification of a polished cross-section through the thickness of a multilayer prior art TBC, illustrating vertical cracks.
Figure 2B:
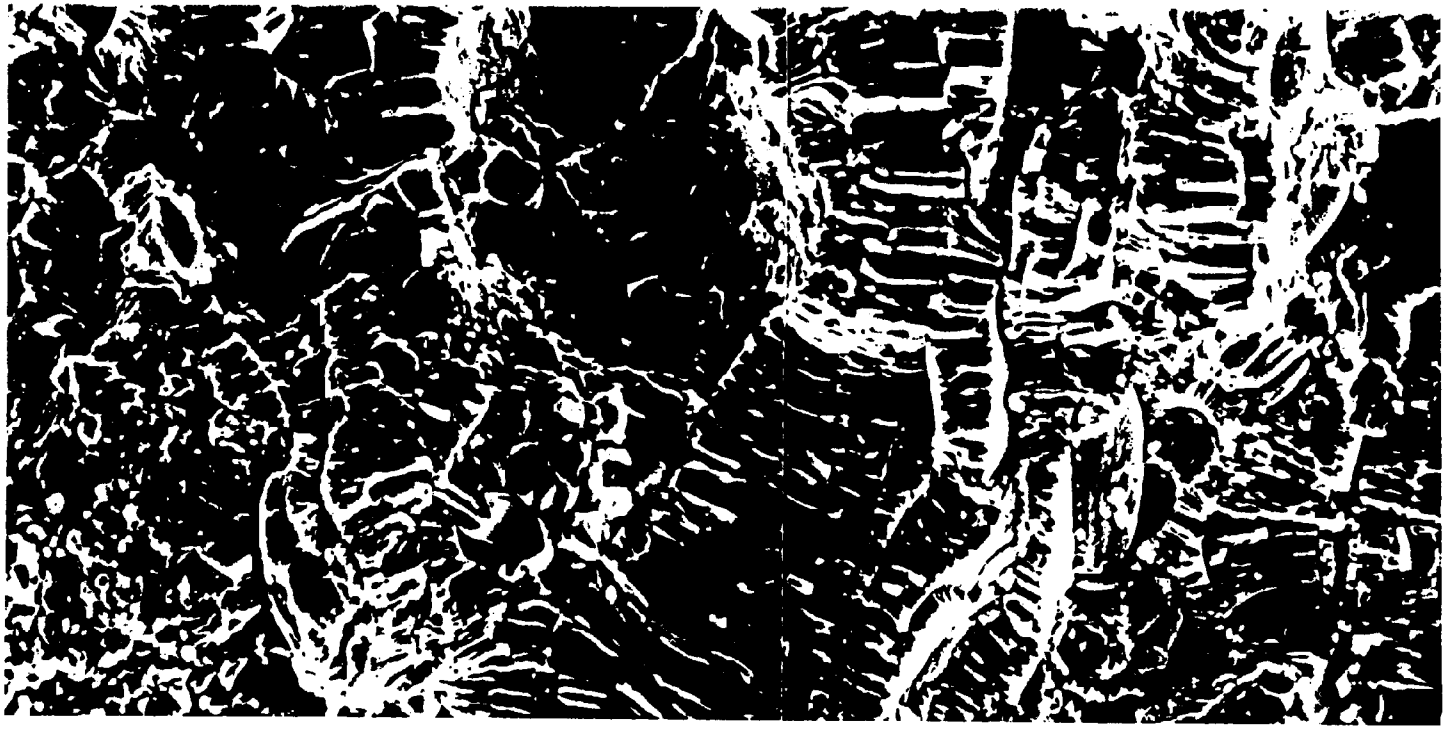
FIG. 2*b* is a SEM photomicrograph taken at 2000× magnification of a fracture surface through the thickness of the TBC of FIG. 2*a*.
Figure 3A:
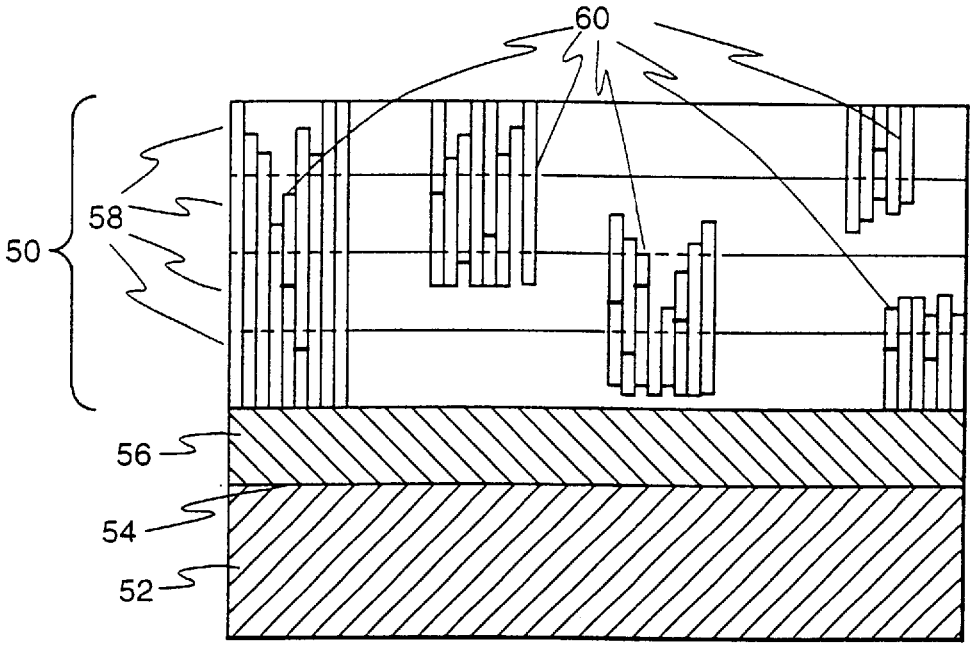
FIG. 3*a* is a schematic cross-section of a TBC of the present invention.
Figure 3B:
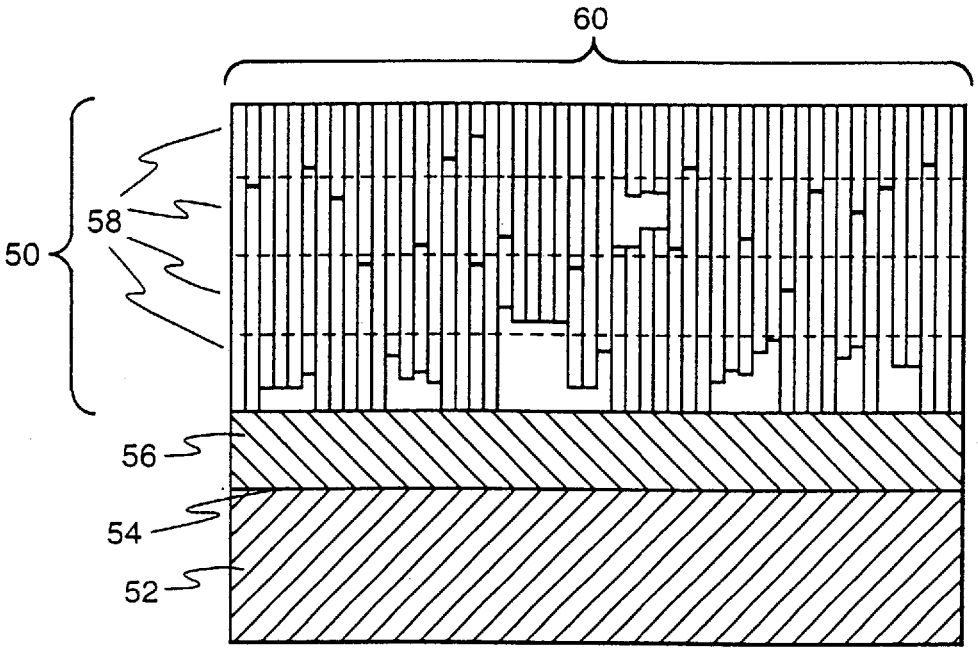
FIG. 3*b* is a schematic cross-section of a TBC of the present invention.

FIGS. 3*a* and 3*b* are schematic cross-sections of TBCs which are intended to illustrate a coherent, continuous columnar grain microstructure and examples of the differing degrees in which such a microstructure may exist. Referring to the schematic FIGS. 3*a* and 3*b,* articles having a TBC 50 of the present invention are formed by depositing a TBC 50 on a substrate 52. In a preferred embodiment, the substrate 52 is a metal alloy such as a Ni-based, Ti-based or Co-based alloy. However, Applicants believe that many other materials are possible for use as substrate 52, such as other metal alloys, metal matrix composites and other materials, so long as the substrate is capable of conducting heat so as to provide conditions favorable to the formation of a coherent, continuous columnar grain microstructure as further described herein. Substrate 52 may be adapted so as to receive TBC 50 on one surface 54, or on a plurality of surfaces (not shown). Surface 54 may also incorporate a bond coat 56 to promote bonding of TBC 50 to substrate 52 surface 54. Bond coat 56 may comprise any material which promotes bonding of TBC 50 to substrate 52, and may include, for example, known plasma-spray coatings of metal alloys whose acronym, MCrAlY, designates the elements comprising the alloy where M is Ni, Co, or combinations of Ni and Co.

TBC 50 may comprise plasma-sprayed ceramic materials. In a preferred embodiment, the ceramic material is a metal oxide, such as yttria stabilized zirconia having a composition of 6–8 weight percent yttria with a balance of zirconia that is built up by plasma-spraying a plurality of layers 58. However, other TBC materials are possible including metallic carbides, nitrides and other ceramic materials. A layer 58, also termed having an "individual layer" or "ceramic layer", is defined as the thickness of ceramic material deposited in a given plane or unit of area during one pass of a plasma-spray torch, and includes both primary layers and sub-layers as described herein. In order to cover the entire surface of a substrate and obtain the necessary thickness of a TBC, it is generally desirable that the plasma-spray torch and the substrate be moved in relation to one another when depositing the TBC. This can take the form of moving the torch, substrate, or both, and is analogous to processes used for spray painting. This motion, combined with the fact that a given plasma-spray torch sprays a pattern which covers a finite area (e.g. has a torch footprint), results in the TBC being deposited in layers 58.

Well known methods and apparatuses may be used to make a TBC 50 of the present invention. Several specific methods and apparatuses are described in the background above and examples given below.

Applicants have observed that in prior art TBCs, the interface region between layers is frequently the location of horizontal macrocracks. Applicants have further observed that such macrocracks are caused, at least in part, by poor or non-existent micro-welding between layers. Micro-welding in this context is defined as remelting of a microlayer of the previously deposited surface which, in combination with directional solidification as discussed further below, results in a continuous crystallographic ordering between adjacent ceramic particles which is evidenced by a continuity of the grain or crystal structure between such particles. Good micro-welding is evidenced in TBCs by continuous columnar grain growth between adjacent ceramic particles. Applicants have also observed that in prior art TBCs, weak or non-existent micro-welding may exist not only at the interfaces between primary layers, but also between sub-layers within primary layers as discussed above and shown in FIG. 1*b*.

Referring again to FIGS. 3*a* and 3*b*, TBC 50 of the present invention is characterized by having a coherent, continuous columnar grain microstructure. The microstructure is continuous in that each layer 58 comprises a plurality of columnar grains 60 which are generally oriented vertically (i.e. wherein they grow upwardly away from and perpendicular to the substrate) and extend through all, or substantially all, of the thickness of the layer. It is coherent because this columnar growth extends between layers, in that at least some of the plurality of columnar grains existing within a subsequently deposited layer are micro-welded to and extend from columnar grains contained within the layer upon which it is deposited. This occurs by directional solidification as discussed further below. In addition, in TBCs of the present invention, the degree to which the grains are both coherent and continuously columnar may vary. In some cases, the coherency may extend only or mainly between immediately adjacent layers as in FIG. 3*a*, while in others, it may extend between several layers or through the entire thickness of the TBC as in FIG. 3*b*. Also, as illustrated by the comparison of FIGS. 3*a* and 3*b*, in some cases the coherent, continuous columnar grains may represent only a small part of the volume fraction of a TBC, while in others it may represent all, or nearly all, of the volume fraction of the TBC. This is referred to herein as differences in the degree of columnarity.

Figure 4A:
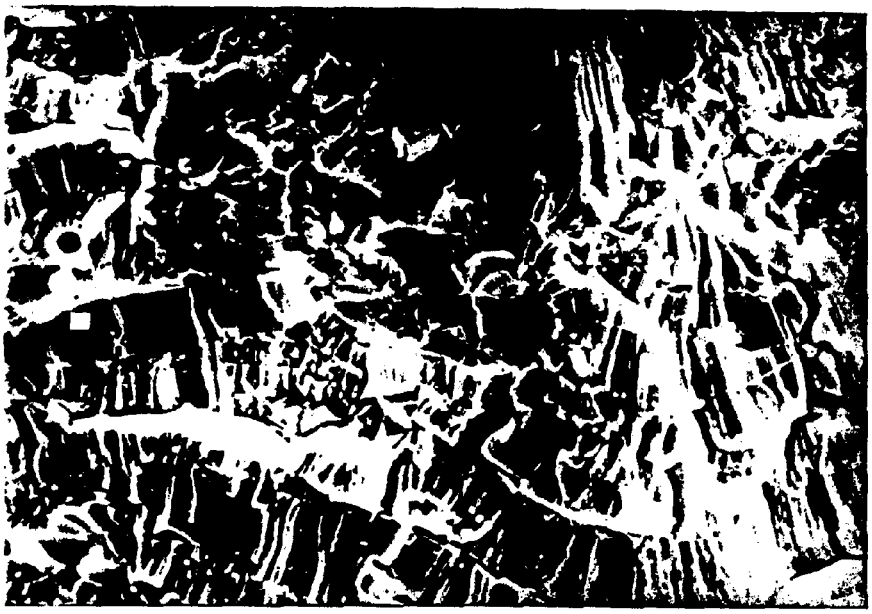
FIG. 4*a* is a SEM photomicrograph taken at 2000× magnification of a TBC of the present invention deposited at a deposition surface temperature of 300° C.
Figure 4B:
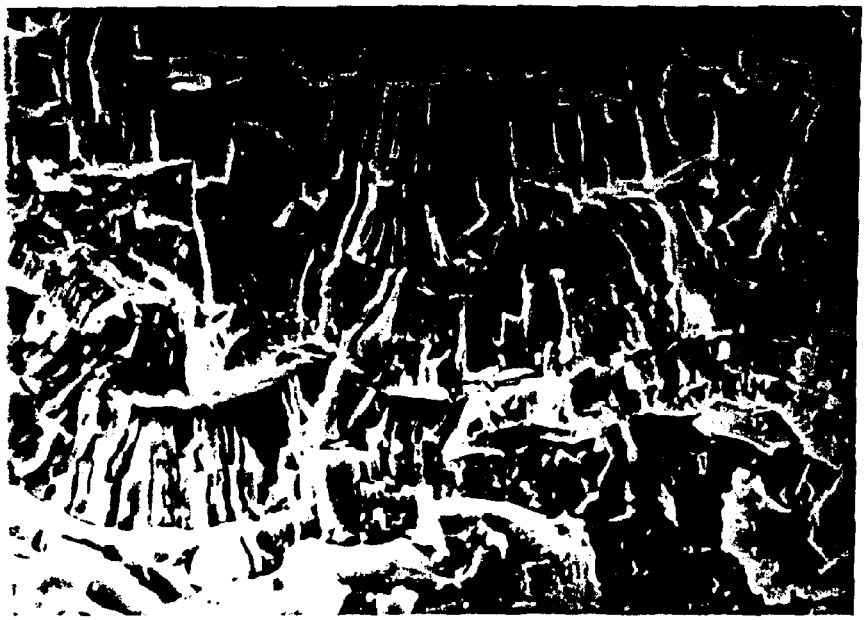
FIG. 4*b* is a SEM photomicrograph taken at 2000× magnification of a TBC of the present invention deposited at a deposition surface temperature of 600° C.
Figure 4C:
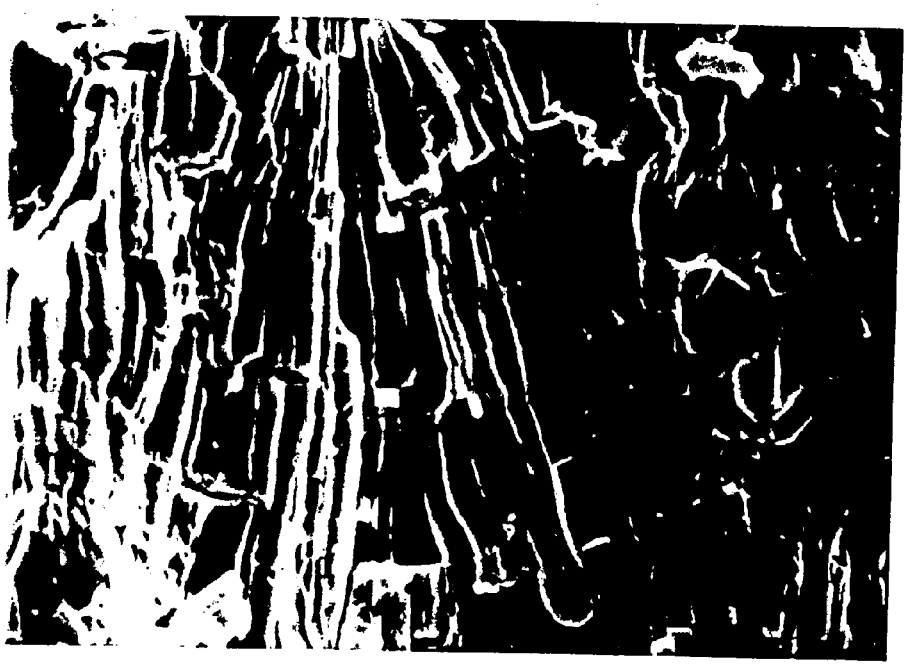
FIG. 4*c* is a SEM photomicrograph taken at 2000× magnification of a TBC of the present invention deposited a deposition surface temperature of 950° C.

Referring now to FIGS. 4*a*–4*c*, the actual coherent, columnar microstructure of TBCs of the present invention are shown. The TBCs of these figures are all made from YSZ having a composition 8 weight percent yttria with a balance of zirconia. In these figures, the vertical bars 70 represent the scaled-up thickness of a single layer for each of these TBCs which was 0.00008 inches. The coherent, continuous columnar microstructure described above may be seen in that in each figure, continuous or nearly continuous columnar grains which extend well beyond the thickness of a single layer may be seen. This indicates that micro-welding has occurred between particles from adjacent layers through localized re-melting and directional solidification so as to cause the development of the coherent, continuously columnar grain microstructure that is characteristic of the present invention.

FIGS. 4*a*–4*c* also demonstrate that the degree of columnarity within TBCs having a microstructure of the present invention is directly related to the temperature of the deposition surface during deposition of the TBC. Generally, the TBC of FIG. 4*a* exhibits a lesser degree of columnarity than those of FIGS. 4*b* or 4*c*, in that it reveals discontinuities in the columnar structure, particularly on the left side of FIG. 4*a*. The microstructure of FIG. 4*a* is a mixture of coherent, continuous columnar grains and grains more closely reflecting prior art microstructures. Applicants have observed that this lesser degree of columnarity correlates to the relatively low deposition surface temperature, as discussed further below. The TBCs represented by FIGS. 4*b* and 4*c*, respectively, reveal increasing degrees of columnarity that correspond to increased deposition surface temperatures of 600° C. and 950° C., respectively. This may be seen in FIGS. 4*b* and 4*c* by the fact that coherent, continuously columnar grains occupy a greater portion of the field of view as compare to FIG. 4*a*. The method and apparatus used for deposition of the TBCs of FIGS. 4*a*–4*c* is described in Example 1 below.

Figure 5A:
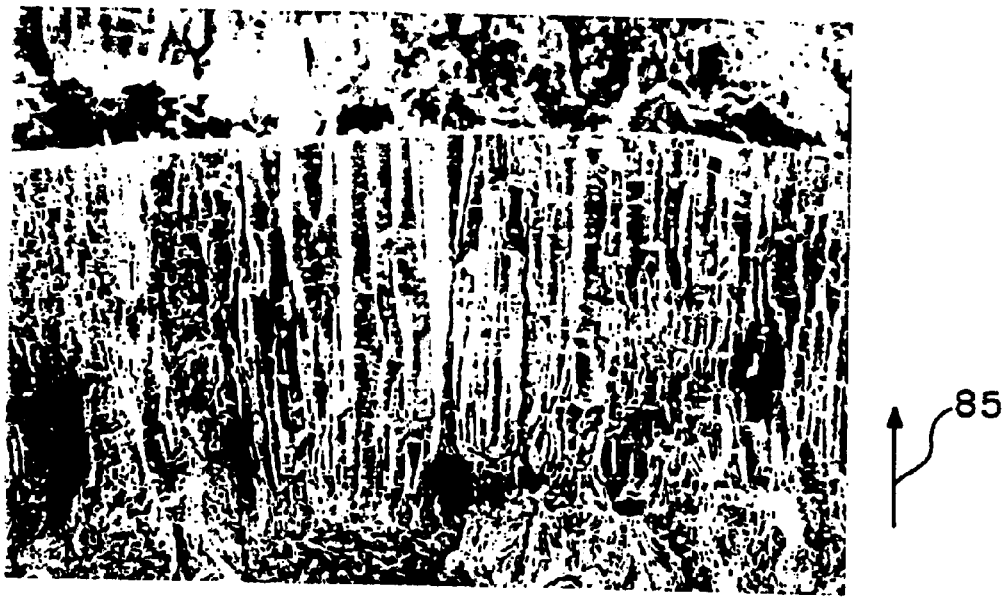
FIG. 5*a* is a SEM photomicrograph taken at 120× magnification of a TBC of the present invention having coherent, continuous columnar grains extending through substantially all of the thickness of the TBC.
Figure 5B:
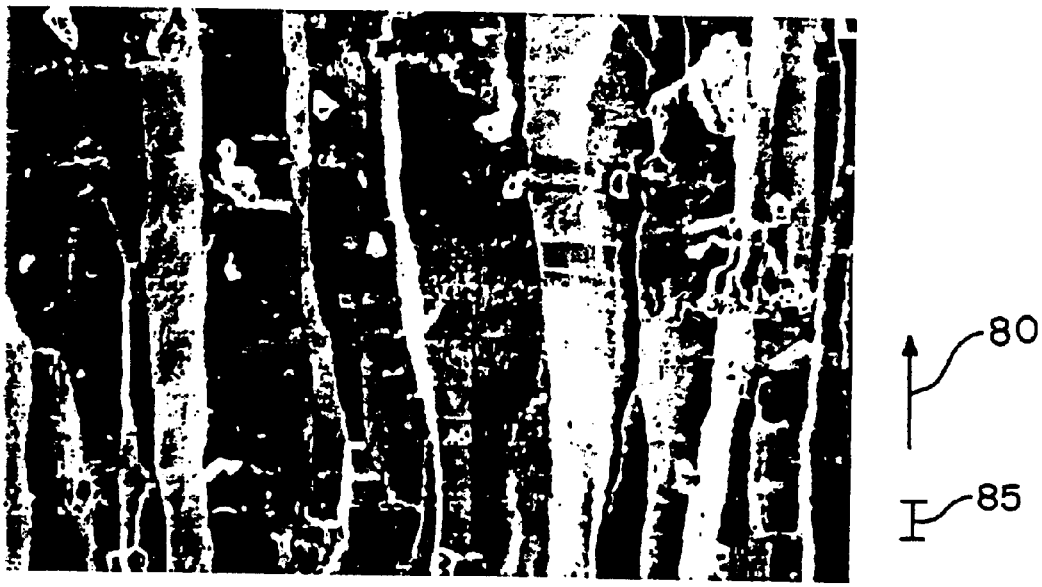
FIG. 5*b* is a SEM micrograph at 507× magnification of the TBC of FIG. 4*a,* further illustrating the coherency of the continuous columnar microstructure and a vertical crack.

The dependence of the degree of columnarity on the deposition surface temperature is further exemplified in FIGS. 5*a* and 5*b*, wherein the amount of the coherent, continuous columnar microstructure is even more pronounced. Grains may be seen in these Figures that extend from very near the substrate surface through substantially all of the thickness of the TBC. Arrow 80 on FIGS. 5*a* and 5*b* points in the direction of the surface of the TBC. The approximate thickness of an individual layer in this TBC is about 0.0003 inches and is shown by vertical bar 85 in FIG. 5*b*. In this TBC, the exact deposition surface temperature during deposition of the TBC is unknown, however, Applicants believe that it was sufficiently high enough to allow the heat content of the arriving molten droplets to remelt the full thickness of the previous layer. The surface had a wetted, glazed appearance after deposition that was different from the appearance of the surfaces of other TBCs deposited by Applicants, including the TBCs of FIGS. 4*a*–4*c*. The glazed look comes from the increased transparency of the coating. The conclusion of a greater depth of remelt is also based in part on the high degree of columnarity of the resultant TBCs. The method and apparatus used for this deposition is described in Example 2.

Applicants have determined that TBCs made from yttria stabilized zirconia, having a composition of about 8 weight percent yttria, begin to evidence a coherent, continuous columnar microstructure at a surface deposition temperature of about 300° C. as shown in the microstructure of FIG. 4*a*, which is about $0.2T_m$, where $T_m$ is the absolute melting temperature of zirconia. As shown in FIG. 4*c*, a more preferred coherent, continuous columnar structure exists when the surface deposition temperature is higher, in this case about 0.4 $T_m$. With other ceramic materials, the minimum deposition surface temperature at which a coherent, continuous columnar structure may be created would be expected to vary depending on the ceramic material selected; based on factors which would be expected to affect micro-welding including the crystal structure, melting temperature and heat capacity of the ceramic material, and perhaps others. However, based on the results with YSZ, Applicants would expect some degree of a coherent, columnar microstructure to be developed in substantially all plasma-sprayed ceramic TBCs wherein the deposition surface temperature is in the range of about 0.2–0.5 of the absolute melting temperature of the ceramic material used to form the TBC. The degree of columnarity for other ceramic TBCs is also expected to increase with increasing deposition surface temperature.

Applicants believe that, as the temperature of a TBC deposition surface is raised to a temperature which is at or above the threshold noted during plasma-spraying, the combination of the heat contained in the incoming ceramic particles and the heat available at deposition surface is sufficient to promote localized re-melting of the deposition surface in the area under the deposited particles, such that columnar directional solidification of the incoming particles from the grains of the adjacent underlying layers is possible. This is supported by the continuous columnar structures observed in FIGS. 4*a*–4*c* and FIGS. 5*a* and 5*b*, and also by the fact that Applicants have noted that the ability to distinguish individual particles in the microstructures represented by these Figures is greatly reduced, when compared for instance with the microstructure of FIG. 1*b*. After localized remelting, directional solidification occurs in the direction of the outer surface of the TBC so long as the heat associated with the deposition is removed through the substrate. Removal of the heat in the direction of the substrate produces a thermal gradient that promotes sequential directional solidification in the molten regions of the TBC in the opposite direction, or toward the surface of the TBC, according to known metallurgical principles relating to directional solidification processes. Establishment of proper thermal gradients is necessary for producing TBCs having a coherent, continuous columnar grain structure.

Applicants have also observed that TBCs containing the coherent, continuous columnar microstructure of the present invention also contain beneficial vertical or columnar macrocracks, and a reduced amount of horizontal cracking, particularly horizontal macrocracking that has been observed in prior art TBCs. As the deposition surface temperature and the degree of columnarity increases, the amount and severity of horizontal or in-plane cracking decreases. Vertical macrocracking may be seen in FIGS. 5*a* and 5*b*. Reduced horizontal cracking can be seen, for instance, by comparing the microstructure shown in FIGS. 5*a*, 5*b* or 4*c* with the microstructures shown in FIGS. 1*b* or 4*a* that were deposited at lower deposition surface temperatures.

As the degree of columnarity of the microstructure of the TBCs of the present invention increases, certain mechanical properties of the TBCs are also improved. Firstly, generally as the degree of columnarity increases, the in-plane tensile strength of the TBCs also increases. Tensile strength of the TBC normal to the substrate interface is measured with the TBC attached to the substrate using known tensile adhesion testing techniques. The tensile load is applied until failure occurs. The load at failure divided by the area over which the load is applied provides a tensile strength. In general, the tensile strengths observed for TBCs of the present invention are greater than the tensile strengths of prior art TBCs. The best values observed for prior art TBCs are about 3000–5000 psi, while the best TBCs of the present invention have been measured in the range of 5000–10,000 psi, and higher values are thought to be achievable. Secondly, generally, as the degree of columnarity increases, the in-plane, effective elastic modulus of the TBCs decreases. The modulus of elasticity of a TBC that has been removed from the substrate and any bond coat upon which it was deposited is measured by employing a three point bending apparatus and known mechanical testing techniques and mechanical analysis algorithms. The measured value is termed an "effective" modulus of elasticity, because the TBCs contain vertical macrocracks which affect the measured values for the modulus. In general, the effective elastic moduli for TBCs of the present invention are lower than the effective elastic moduli of prior art TBCs. The best elastic modulus measurements on prior art TBC range from about $0.5\times10^6$ to $1.0\times10^6$ psi, while the best TBCs of the present invention have been measured as low as about $0.1\times10^6$ psi, and lower values are believed to be achievable. Increases in TBC tensile strength and reduction in TBC in-plane modulus described above have been correlated with improved spallation resistance in TBCs, however, the specific relationship between the improvements in the microstructure described herein (and the associated mechanical property improvements) and increased spallation resistance are not yet known. Several high temperature thermal cycling experiments have been conducted on TBCs of the present invention (cycling the temperature repeatedly from approximately room temperature to 2000° F.), and a trend toward improved spallation resistance has been observed, but no fixed relationship has yet been determined.

While the majority of TBCs are currently applied as a plurality of layers, Applicants believe that it also may be possible to have a continuous columnar structure within a full thickness, single layer TBC formed by a single torch pass. For thin single layers, on the order of 0.001 in. thick or less, such a continuous columnar structure may not be new, being analogous to continuous columnar structures that have been observed by Applicants within a single layer of a multi-layer TBC. However, Applicants believe that continuous columnar structures in thicker single layer TBCs, in the range of 0.001 in. or greater, have not been previously demonstrated within the individual layers of multi-layer TBCs. Therefore, Applicants believe that such thicker single layers containing a plurality of continuous columnar grains would represent a new form of TBC, and may offer the potential for further advancements because, for example, such single layer TBCs may also have fewer horizontal cracks than prior art TBCs, since the crack forming mechanisms associated with the deposition of multi-layer TBCs described above may be eliminated. Depending on the material selected as the substrate or bond coat, single layer TBCs having a thickness in the range mentioned may require additional cooling of the substrate as compared to depositions made in several passes, in order to prevent the additional heat associated with deposition of a thicker single layer from damaging these materials.

Also, control of the deposition conditions in order to promote directional solidification, as described above, is important to the development of a continuous columnar microstructure; whether in a single layer or a multi-layer TBC. In order to develop a continuous columnar structure, regardless of the number of layers deposited, it is necessary both to promote micro-welding as discussed above, and to assure that the growth of the grains from each subsequently deposited molten ceramic particle proceeds from the micro-welded region into the still molten particle. It is known that, in order to promote such directional solidification, the heat associated with the deposit-on must be extracted through the micro-welded region (i.e. in the direction of the substrate). Therefore, it is essential that the substrate and the plasma-spray deposition apparatus be configured to permit removal of the heat of deposition in a direction opposite from the desired grain growth direction within the TBC in order to achieve directionally solidified continuous columnar grains.

Articles having TBCs with the coherent, continuous columnar grain microstructure of the present invention, or continuous columnar grains in the case of a single layer TBC, may be made using well-known methods and apparatuses for plasma-spraying. As described above, the deposition of TBCs having such microstructures requires that the temperature of the deposition surface be maintained above a threshold temperature. In the case of YSZ TBCs, the temperature of the deposition surface should be maintained at least above about 300° C., and preferably significantly higher in the range of 600° C. or above.

EXAMPLE 1

The apparatus and method of this example were particularly directed toward determination of the deposition surface temperature required for micro-welding of a newly deposited layer of YSZ to a previously plasma-sprayed layer of YSZ. The apparatus was fixtured so that the deposition surface temperature of a previously deposited TBC layer could be measured just before it re-entered the plasma flame for deposition of the next layer. Use of this apparatus and method also permitted the study of the degree of columnarity within a TBC as a function of the deposition surface temperature.

The apparatus comprised a cylindrical, 4 in. diameter, 12 in. long drum made from 0.25 inch thick low-carbon steel, with each of four drums to serve as substrates and to receive a TBC under different deposition conditions. Each drum was mounted vertically on a turntable to permit rotation about its cylindrical axis during deposition of the TBC. During the deposition of the TBC, each drum was rotated at about 300 revolutions per minute. A DC plasma torch Model 7MB made by Metco, Inc. was mounted at a fixed distance perpendicular to the surface of the drum such that it could be translated parallel to the cylindrical axis of the drum. The distance from the torch to the surface of the drum at the beginning of the deposition was approximately 2.75 inches.

A single color pyrometer operating at a 5 $\mu$m wavelength was used to measure the deposition surface temperatures. The pyrometer was aimed perpendicular to the surface of the drum in line with the deposition stripe and at a radial angle of about 50° from the torch as measured between these devices, such that the pyrometer was measuring temperature on an area in the center of the TBC stripe, as the stripe was being deposited by the plasma torch on the drum. Each drum was rotated in a direction such that a heated area of deposit would pass the pyrometer just prior to entering the plume of the plasma torch. This arrangement allowed the surface temperature to be recorded approximately 0.03 seconds before the TBC stripe re-entered the plasma-spray. Each of the drums and the turntable were adapted to permit the preheating of the drums to a controlled temperature.

Lighting of the plasma torch was done above each drum. After the plasma torch was lit, the ceramic powder feed was turned on while the torch was still in the torch lighting position. The powder was −230 mesh Metco HOSP YSZ having a composition of 8 weight percent yttria with a balance of zirconia. The powder was fed to the torch at a rate of 3 lb/hr. The torch current was 600 A. The plasma torch was then translated down onto the rotating drum and held stationary for about 20–40 seconds for deposition of a stripe. During the deposition, the pyrometer took continuous temperature measurements of the deposition surface just before it re-entered the plasma, so as to record the deposition surface temperature as a function of the location within the deposited TBC. The deposits that resulted were between 0.010 and 0.017 inches thick, and were in the form of a TBC stripe around the circumference of the drum. After a predetermined deposition time, the torch was moved back to the lighting position and then shut off.

As expected, the temperature data for a single deposited stripe showed that the deposition temperature of the TBC stripe increased with increasing layer thickness. Four separate TBC stripes were made, one on each of the four drums, each TBC representing a different deposition surface temperature range. Different deposition surface temperature ranges were achieved by using various degrees of drum preheating before applying the TBC stripe, and by air cooling the deposit during the deposition if necessary. The four temperature ranges were 100–370° C., 360–470° C., 520–600° C. and 880–950° C.

Figure 6:
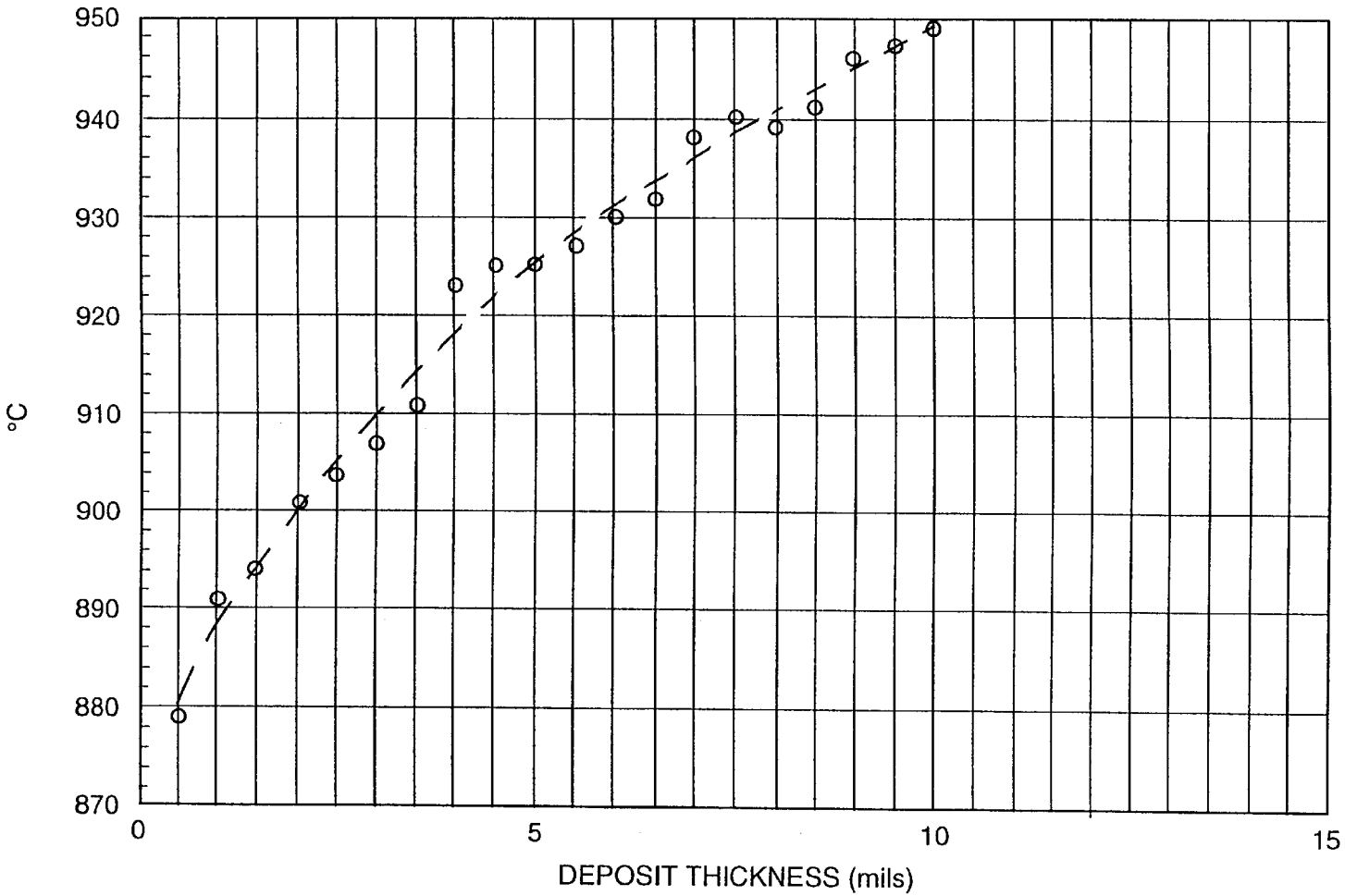
FIG. 6 is a graph showing the deposition temperature as a function of location within a TBC.

After deposition, the coatings were fractured and the fracture surfaces were analyzed by SEM. SEM fractographs of the deposits were taken in the center of the TBC stripes where the temperature measurements were recorded. Some of the results are shown as FIGS. 4*a*–4*c*. Curves identifying the surface deposition temperature as a function of the TBC stripe thickness were generated for each of the stripes deposited and used to correlate the resultant microstructure of the TBC with the deposition surface temperature. FIG. 6 is an example of such a curve for one of the TBC stripes. The deposit thickness of 0 mils on this curve corresponds to the area within the TBC adjacent to the drum, while the deposit thickness of 10 mils corresponds to the outer surface of the TBC. Microstructural analysis of fracture surfaces of the TBC stripes was performed using SEM photomicrographs. Regions within the thickness of TBC stripes were correlated to specific deposition surface temperatures. The SEM analysis permitted determination of the deposition surface temperature at which micro-welding and the coherent, continuous columnar microstructure began to develop, and enabled correlation of improvements in the degree of columnarity with increasing surface deposition temperature, as discussed above.

EXAMPLE 2

In a second experiment, the effect of the deposition surface temperature on the microstructure of a YSZ TBC was further demonstrated. The deposition apparatus was simple, and involved the use of a DC air plasma-spray torch to deposit a TBC on a 0.125 inch thick Inconel 718 (Ni-based alloy) plate as a substrate. The torch was positioned such that it could be translated at a fixed distance of 1 inch above the surface of the plate. The torch to substrate distance chosen was such that the plasma-flame contacted the substrate directly, thereby causing higher than normal deposition surface temperatures. The DC plasma torch used was a Model 7MB made by Metco, Inc. The torch current was 600 A. The powder was −120 mesh Metco HOSP YSZ having a composition of 8 weight percent yttria and a balance of zirconia. The powder was fed to the torch at a rate of 3 lb/hr. The total number of deposition passes was about 60, and the thickness deposited per pass was about 0.0003 inches.

The TBC was deposited by translating the torch back and forth across the surface of the plate. While no direct deposition surface temperature measurements were made, as noted above Applicants believe that the surface temperatures during this deposition were hotter than those employed by Applicants during the deposition of other TBCs, including those of Example 1, because the surface had a wetted, glazed appearance. The resulting TBC is shown in FIGS. 5*a* and 5*b*. As discussed above with reference to FIGS. 5*a* and 5*b,* the significant degree of columnarity of the resultant TBC also indicated that the deposition surface temperature was very hot, and based on the comparison of the degree of columnarity of the microstructures of FIGS. 5*a* and 5*b* and FIG. 4*c,* the temperature would appear to have been significantly greater than 950° C.

The preceding examples and description of TBCs are intended to be illustrative of the present invention, but not to limit the scope of the invention to the specific embodiments described therein.

What is claimed is:

1. A thermal barrier coating that is adapted to be deposited on a substrate surface, the thermal barrier coating comprising:

a plurality of ceramic layers, the plurality of ceramic layers being disposed adjacent to one another, each ceramic layer of the thermal barrier coating having a thickness and a microstructure, the microstructure comprising a plurality of ceramic particles bonded to each other, the ceramic particles forming directionally solidified continous columnar grains being oriented generally parallel with each other and perpendicular to the surface, the continous columnar grains extending through the thickness of each ceramic layer, at least some of the ceramic layers that comprise the directionallt solidified continous columnar grains extend from one ceramic layer into an adjacent ceramic layer and the at least some of the ceramic layers being coherent with directionally solidified continous columnar grains within the adjacent ceramic layer, and forming a coherent columnar microstructure in the thermal barrier coating during deposition;

wherein the deposition surface temperature is in the range from about .2 to about 0.5 of the absolute melting temperature of the ceramic material used to form the thermal barrier coating.

2. A thermal barrier coating adapted to be bonded to a metallic bond coat surface, the thermal barrier coating comprising:

a plurality of ceramic layers, the plurality of ceramic layers being disposed adjacent to one another, each of the ceramic layers comprising a thickness and a microstructure, the microstructure comprising a plurality of ceramic particles that are bonded to each other, the ceramic particles forming directionally solidified continous columnar grains, the directionally solidified continous columnar grains being oriented generally perpendicular to the metallic bond coat surface, the directionally solidified continous columnar grains extend through a thickness of each ceramic layer, at least some of the ceramic layer extend into an adjacent ceramic layer and the at least some of the ceramic layers that comprise the directionally solidified continous columnar grains being coherent with directionally solidified continous columnar grains within the adjacent ceramic layer for forming a coherent columnar microstructure in the thermal barrier coating during disposition;

wherein the deposition surface temperature is in the range from about 0.2 to about 0.5 of the absolute melting temperature of the ceramic material used to form the thermal barrier coating.

3. A ceramic thermal barrier coating adapted to be deposited on a substrate surface by a plasma spraying process by which at least partially molten ceramic particles form a plurality of layers, the ceramic thermal barrier coating comprising:

a plurality of layers, each of the plurality of layers comprising a thickness and a microstructure, the microstructure comprising a plurality of microwelded outwardly extending, continuous columnar grains, the microwelded outwardly extending, continuous columnar grains being formed by directional solidification of the ceramic particles as heat associated with the plasma spray process is extracted through the substrate, wherein each of the layers has a plurality of microwelded outwardly extending continuous columnar grains extending continuously and completely through the thickness of one layer of the plurality of layers, some of the microwelded outwardly extending, continuous columnar grains existing within a subsequently deposited layer being microwelded to and extending from microwelded outwardly extending, continuous columnar grains of the one layer to microwelded outwardly extending, columnar continuous grains of the adjacent subsequently disposed layer to form a coherent columnar microstructure in the ceramic thermal barrier coating.

4. A thermal barrier coating according to claim 3 wherein a deposition surface temperature is in a range from about 0.2 to about 0.5 of the absolute melting temperature of the ceramic material used to form the ceramic thermal barrier coating.

* * * * *